US007106152B2

(12) United States Patent
Yamakawa et al.

(10) Patent No.: US 7,106,152 B2
(45) Date of Patent: Sep. 12, 2006

(54) DIELECTRIC RESONATOR, DIELECTRIC FILTER, AND METHOD OF SUPPORTING DIELECTRIC RESONANCE ELEMENT

(75) Inventors: Takehiko Yamakawa, Osaka (JP); Toshio Ishizaki, Hyogo (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 43 days.

(21) Appl. No.: 10/911,078

(22) Filed: Aug. 3, 2004

(65) Prior Publication Data

US 2005/0030131 A1 Feb. 10, 2005

(30) Foreign Application Priority Data

Aug. 4, 2003 (JP) ..... 2003-286137

(51) Int. Cl.
*H01P 7/00* (2006.01)

(52) U.S. Cl. ..... 333/219; 333/202; 333/222; 333/234

(58) Field of Classification Search ..... 333/202, 333/203, 206, 207, 222, 229, 234, 219, 219.1
See application file for complete search history.

(56) References Cited

U.S. PATENT DOCUMENTS 4,639,699 A * 1/1987 Nishikawa et al. ..... 333/202
5,027,090 A * 6/1991 Gueble et al. ..... 333/202
6,750,739 B1 * 6/2004 Enokihara et al. ..... 333/202
2003/0058067 A1 3/2003 Wakamatsu et al.

FOREIGN PATENT DOCUMENTS

| | | |
|---|---|---|
| EP | 1 148 574 A2 | 10/2001 |
| GB | 2 188 789 A | 10/1987 |
| JP | 63-22727 | 5/1988 |
| JP | 63-22728 | 5/1988 |
| JP | 63-22729 | 5/1988 |
| JP | 2002-094308 | 3/2002 |

OTHER PUBLICATIONS

European Search Report for EP 04 01 8401, dated Sep. 30, 2004.

* cited by examiner

*Primary Examiner*—Seungsook Ham
(74) *Attorney, Agent, or Firm*—RatnerPrestia

(57) ABSTRACT

A dielectric resonator has a metallic casing having an opening, a metallic cover which covers the opening, and a dielectric resonance element having a pair of flat surfaces formed opposite from each other, one of the pair of flat surfaces being brought into contact with a bottom portion of the casing. At least one of the cover and the bottom portion has a resilient portion which supports the dielectric resonance element and presses one of the pair of flat surfaces by a biasing force so as to follow expansion or contraction of the dielectric resonance element due to a change in temperature. The biasing force applied from the resilient portion is obtained by warping of a portion of the cover or a portion of the bottom portion that one of the pair of flat surfaces or an edge portion of the flat surface contacts.

11 Claims, 10 Drawing Sheets

Fig. 9 (a) PRIOR ART
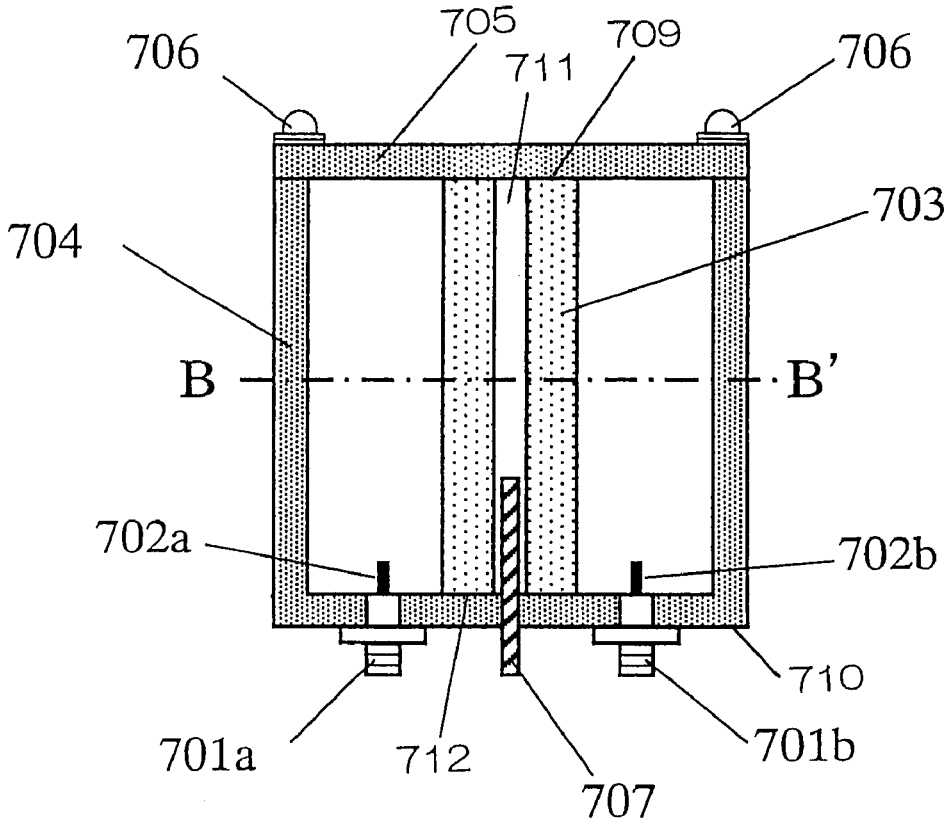
Fig. 9 (b) PRIOR ART
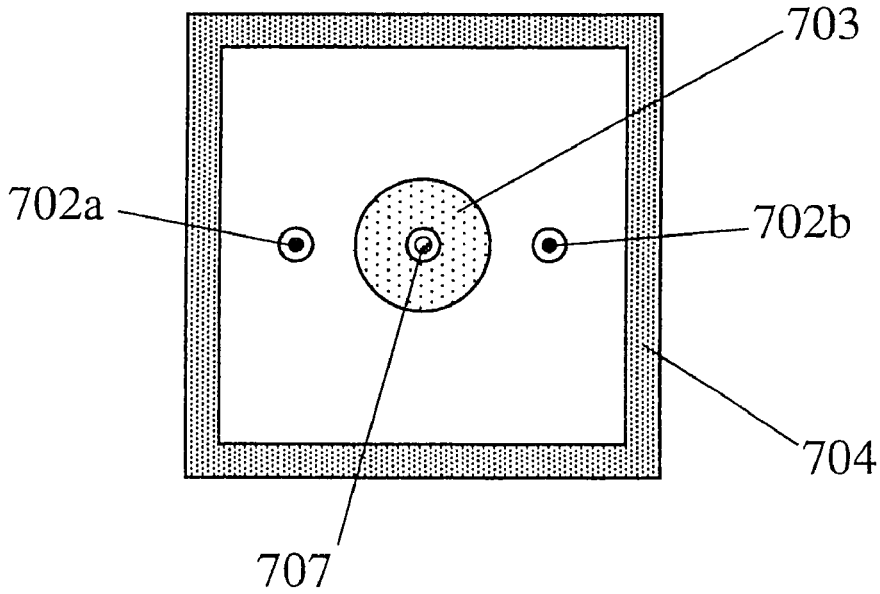

DIELECTRIC RESONATOR, DIELECTRIC FILTER, AND METHOD OF SUPPORTING DIELECTRIC RESONANCE ELEMENT

BACKGROUND OF THE INVENTION

1. Field of the Invention

The present invention relates to a dielectric resonator and a dielectric filter for use in a base station for mobile communication such as portable telephone, a transmitting station for broadcasting, and the like, and to a method of supporting a dielectric resonance element used in the dielectric resonator and the dielectric filter.

2. Related Art of the Invention

In recent years, high-sensitivity transmission/reception performance and good communication quality have become indispensable to portable telephone systems. It is, therefore, required that a filter for use in a base station should have a low-loss transmission characteristic such as to cause substantially no degradation in signal components and a sharp attenuation characteristic such as to reliably remove unnecessary interfering wave components. Also, there has been an increasing demand for reducing the size as well as improving electrical characteristics. An example of filters capable of meeting such a demand is a TM mode dielectric filter using a TM mode dielectric resonator of a high Q-value.

An example of a conventional dielectric resonator and a dielectric filter using the dielectric resonator will be described with reference to drawings. FIG. 9(*a*) is a cross-sectional view of a conventional TM mode dielectric resonator, FIG. 9(*b*) is a cross-sectional view of the conventional TM mode dielectric resonator taken along the line B–B' in FIG. 9(*a*) and seen from a position above the resonator, and FIG. 10 shows an electromagnetic field distribution in the conventional dielectric resonator. The dielectric resonator has input/output terminals 701*a* and 701*b*, input/output probes 702*a* and 702*b*, a dielectric resonance element 703, a metallic casing 704, a metallic cover 705, connecting screws 706, and a frequency adjusting screw 707. Arrow 801 indicates an electric force line and arrow 802 indicates a magnetic force line. Input/output probes 702*a* and 702*b* are connected to center conductors of the input/output terminals 701*a* and 701*b* by soldering or the like.

The dielectric resonance element 703 has a cylindrical shape, is placed substantially at a center of the casing 704, and is pinched between a bottom surface 710 of the casing 704 and the metallic cover 705, with its upper flat surface 709 placed on the metallic cover 705 and its lower flat surface 712 placed on the bottom surface 710. The casing 704 and the metallic cover 705 are fixed on each other by connecting screws 706 to improve the degree of contact for connection between the lower flat surface 712 of the dielectric resonance element 703 and the bottom surface 710 of the casing 704 and the degree of contact for connection between the upper flat surface 709 of the dielectric resonance element 703 and the metallic cover 705 and to improve the reliability of connection between the casing 704 and the metallic cover 705 so that the discontinuity of current flowing through the connecting portions is reduced.

An inner hole 711 is formed in the cylindrical dielectric resonance element 703. The frequency adjusting screw 707 connected to the casing 704 is inserted in the inner hole 711 in which electric force lines 801 are concentrated to change the resonance frequency of the dielectric resonator. A signal input to the input/output terminal 701*a* is transferred by electromagnetic coupling between the input/output probe 702*a* and the dielectric resonance element 703 and electromagnetic coupling between the dielectric resonance element 703 and the input/output probe 702*b* to be output through the input/output terminal 701*b*. Thus, this dielectric resonator operates as a TM010 mode dielectric resonator (e.g., see Japanese Patent Publication No. 63-22727, Japanese Patent Publication No. 63-22728, and Japanese Patent Publication No. 63-22729).

In the above-described arrangement, however, a gap occurs between the dielectric resonance element 703 and the metallic casing 704 because of the difference between the linear expansion coefficients thereof when the ambient temperature changes. Considerable changes are thereby caused in the resonance frequency and the Q-value. It is, therefore, difficult to realize a stable resonator and filter. An arrangement has been proposed in which the casing 704 is formed of the same dielectric material as that of the dielectric resonance element 703 to absorb the difference between the linear expansion coefficients of the dielectric resonance element 703 and the metallic casing 704, and in which an electroconductive film is provided on the inner wall (see the above-mentioned patent documents 1 and 3). However, if the casing 704 and the dielectric resonance element 703 are formed of the same dielectric material, the degree of difficulty in manufacturing and the manufacturing cost are increased.

Further, even if a material of a comparatively high conductivity is used as the electroconductive film provided on the inner wall, the conductance of the electroconductive film is lower than that of the metallic casing 704 and the influence on the performance of the resonator of the loss due to the current flowing through the electroconductive film is considerably large, so that the Q-value representing the performance of the resonator is reduced. For this reason, it is difficult to realize a high-performance dielectric resonator and a high-performance filter.

In view of the above-described problems, an object of the present invention is to provide a dielectric filter capable of operating with stability even when a change in temperature occurs, and a method of supporting a dielectric resonance element of the dielectric filter.

SUMMARY OF THE INVENTION

The $1^{st}$ aspect of the present invention is a dielectric resonator comprising:

a metallic casing having an opening;

a metallic cover which covers said opening; and a dielectric resonance element having a pair of flat surfaces formed opposite from each other, one of the pair of flat surfaces being contacting a bottom portion of said casing, wherein at least one of said cover and said bottom portion has a resilient portion which supports said dielectric resonance element and presses said one of the pair of flat surfaces by a biasing force so as to follow expansion or contraction of said dielectric resonance element due to a change in temperature, and wherein the biasing force applied from said resilient portion is obtained by warping of a portion of said cover or a portion of said bottom portion that one of said pair of flat surfaces or an edge portion thereof contacts.

The $2^{nd}$ aspect of the present invention is the dielectric resonator according to the $1^{st}$ aspect of the present invention, wherein the other of said pair of flat surfaces or an edge portion thereof is covered with an electroconductive film.

The $3^{rd}$ aspect of the present invention is the dielectric resonator according to the $2^{nd}$ aspect of the present invention, wherein said electroconductive film is formed by metalization.

The $4^{th}$ aspect of the present invention is the dielectric resonator according to the $2^{nd}$ aspect of the present invention, wherein said resilient portion and the edge portion of the other of said flat surfaces contact in a line contact manner.

The $5^{th}$ aspect of the present invention is the dielectric resonator according to the $1^{st}$ aspect of the present invention, wherein a hole having a size not exceeding the size of the other of said pair of flat surfaces is formed in said cover, wherein the other of said pair of flat surfaces or the edge portion thereof contacts a portion on the periphery of said hole so as to close said hole, and wherein the portion on the periphery of the hole in said cover is warped according to relative expansion of the dielectric resonance element in the axial direction due to a change in temperature to increase the biasing force.

The $6^{th}$ aspect of the present invention is the dielectric resonator according to the $5^{th}$ aspect of the present invention, wherein the thickness of the portion on the periphery of said hole is smaller than the other portion of said cover.

The $7^{th}$ aspect of the present invention is the dielectric resonator according to the $6^{th}$ aspect of the present invention, wherein the portion on the periphery of said hole is formed by countersinking said cover on the side where the other of said pair of flat surfaces contacts said cover.

The $8^{th}$ aspect of the present invention is the dielectric resonator according to the $5^{th}$ aspect of the present invention, wherein another cover is provided over said cover so as to cover said hole.

The $9^{th}$ aspect of the present invention is the dielectric resonator according to the $6^{th}$ aspect of the present invention, wherein the portion on the periphery of said hole and the other portion of said cover connected to each other with being rounded at the connection so as not to form an edge in said casing.

The $10^{th}$ aspect of the present invention is a dielectric resonator comprising:

a metallic casing having an opening;

a cover which covers the opening; and a dielectric resonance element having a pair of flat surfaces formed opposite from each other, one of the pair of flat surfaces being connected to a bottom portion of said casing, wherein at least a portion of at least one of said cover and said bottom portion has ductility such as to comply with expansion or contraction of said dielectric resonance element due to a change in temperature, and the other of said pair of flat surfaces is connected to said cover.

The $11^{th}$ aspect of the present invention is the dielectric resonator according to the $10^{th}$ aspect of the present invention, wherein a recess having a size exceeding the size of the other of said flat surfaces are formed in said cover, and a thin film having electroconductivity and ductility is stretched so as to cover said recess, wherein an electroconductive film is formed on a portion in a side portion adjacent to the other of said pair of flat surfaces of said dielectric resonance element, and wherein said electroconductive film is connected to said thin film by solder or an electroconductive adhesive.

The $12^{th}$ aspect of the present invention is the dielectric resonator according to the $11^{th}$ aspect of the present invention, wherein said electroconductive film is formed by metalization.

The $13^{th}$ aspect of the present invention is the dielectric resonator according to the $10^{th}$ aspect of the present invention, wherein a hole having a size substantially equal to the size of the other of said flat surfaces is formed in said cover, wherein an electroconductive film is formed on the other of said pair of flat surfaces of said dielectric resonance element and on a portion in a side portion adjacent to the other of said pair of flat surfaces, and wherein said electroconductive film is connected to a portion on the periphery of said hole by solder or an electroconductive adhesive.

The $14^{th}$ aspect of the present invention is the dielectric resonator according to the $13^{th}$ aspect of the present invention, wherein the thickness of the portion on the periphery of said hole is smaller than the other portion of said cover.

The $15^{th}$ aspect of the present invention is a dielectric filter comprises dielectric resonators according to the $1^{st}$ or the $10^{th}$ aspect of the present invention, the dielectric resonators being connected one after another to form a plurality of stages.

The $16^{th}$ aspect of the present invention is a method of supporting a dielectric resonance element comprising:

a step of bringing one of a pair of flat surfaces of a dielectric resonance element having flat surfaces opposed to each other into contact with a bottom portion of a metallic casing having an opening; and a step of causing at least one of a metallic cover covering the opening and the bottom portion to press one of the pair of flat surfaces or an edge portion thereof by a biasing force so as to follow expansion or contraction of the dielectric resonance element due to a change in temperature, wherein the biasing force is obtained by warping of a portion of the cover that the other of the pair of flat surfaces or an edge portion thereof contacts.

The $17^{th}$ aspect of the present invention is a method of supporting a dielectric resonance element comprising:

a step of connecting one of a pair of flat surfaces of a dielectric resonance element having flat surfaces opposed to each other to a bottom portion of a metallic casing having an opening; and a step of connecting the other of the pair of flat surfaces to a cover covering the opening, wherein at least a portion of at least one of the bottom portion of the metallic casing and the cover has ductility such as to comply with expansion or contraction of the dielectric resonance element due to a change in temperature.

According to the present invention, a dielectric resonator capable of operating with stability even when a change in temperature occurs, a dielectric filter using the dielectric resonator, a method of supporting a dielectric resonance element of the dielectric resonator can be provided.

BRIEF DESCRIPTION OF THE DRAWINGS

FIG. 1(*b*) is a top view of the dielectric resonator in Embodiment 1 of the present invention.

FIG. 3(*b*) is a top view of the dielectric resonator in Embodiment 1 of the present invention.

4(*b*) is a diagram schematically showing the dielectric resonator in Embodiment 1 of the present invention.

Figure 5:
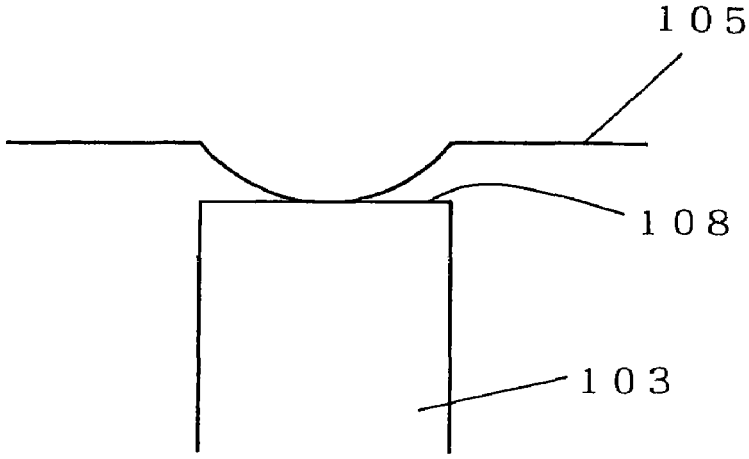
Figure 5:
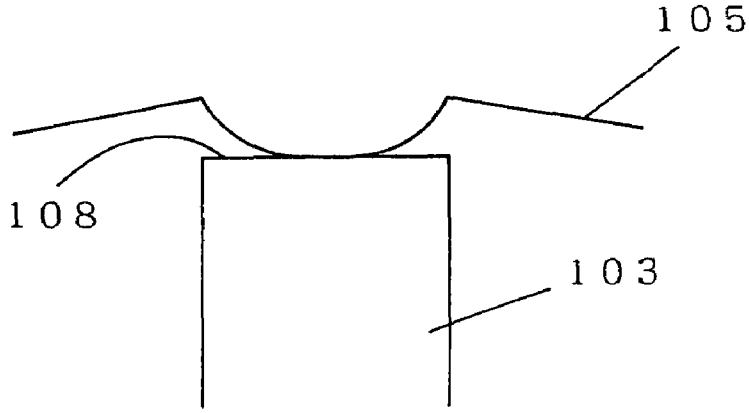

FIG. 5(*a*) is a diagram schematically showing a dielectric resonator in Embodiment 1 of the present invention. FIG. 5(*b*) is a diagram schematically showing the dielectric resonator in Embodiment 1 of the present invention.

Figure 6:
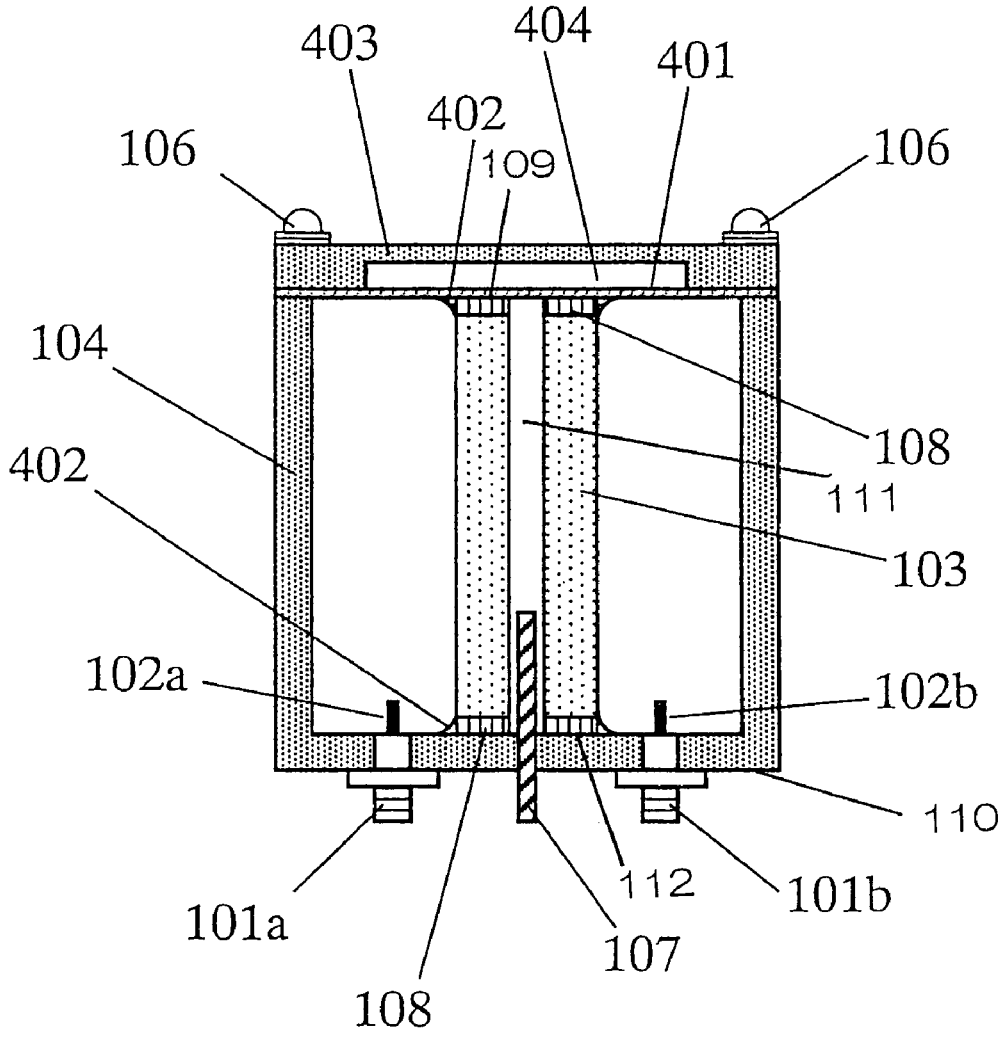

FIG. 6 is a cross-sectional view of a dielectric resonator in Embodiment 2 of the present invention.

Figure 7:
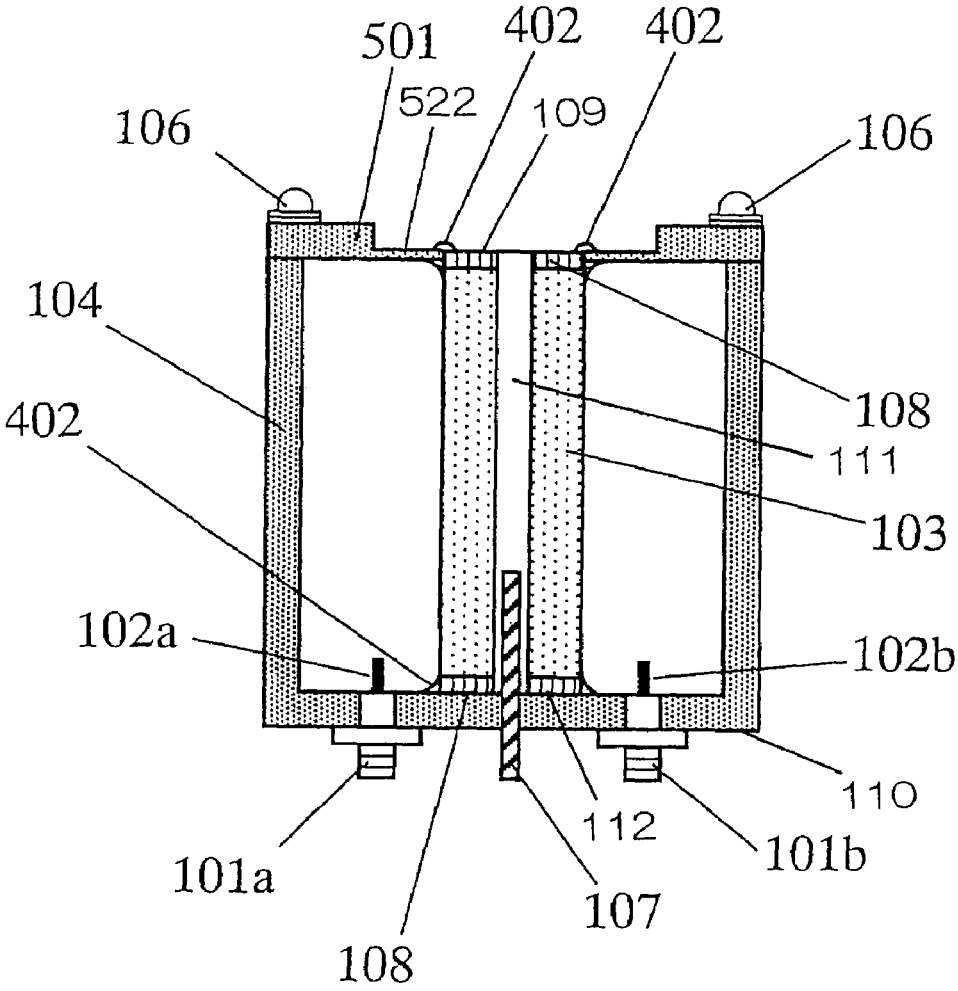

FIG. 7 is a cross-sectional view of a dielectric resonator in Embodiment 3 of the present invention.

Figure 8:
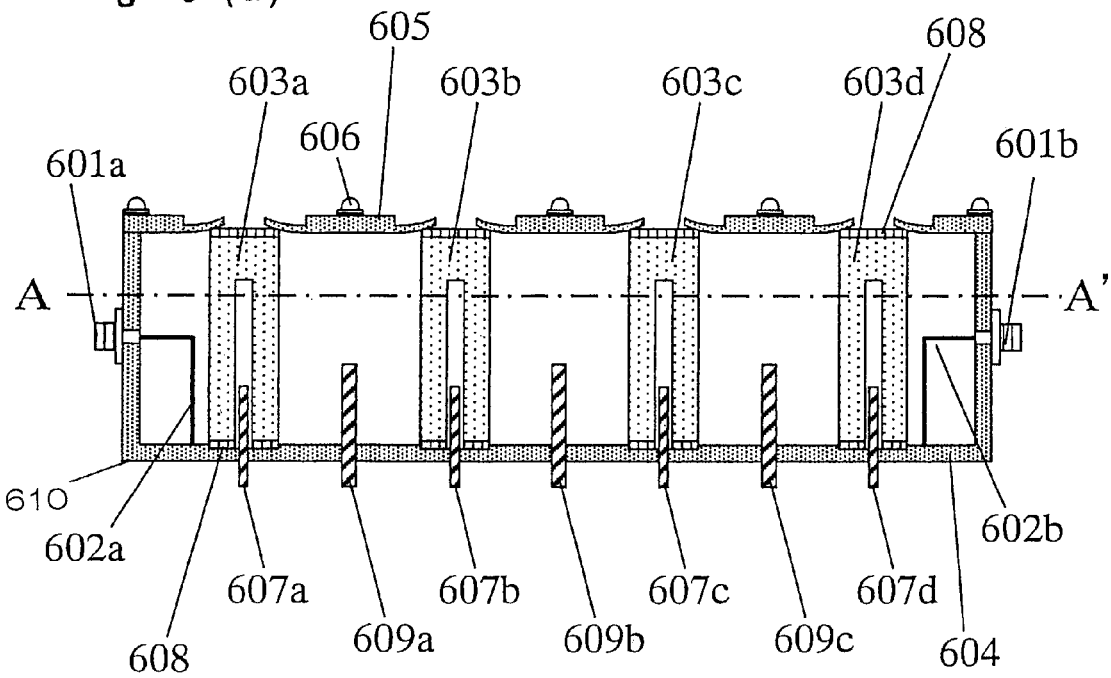
Figure 8:
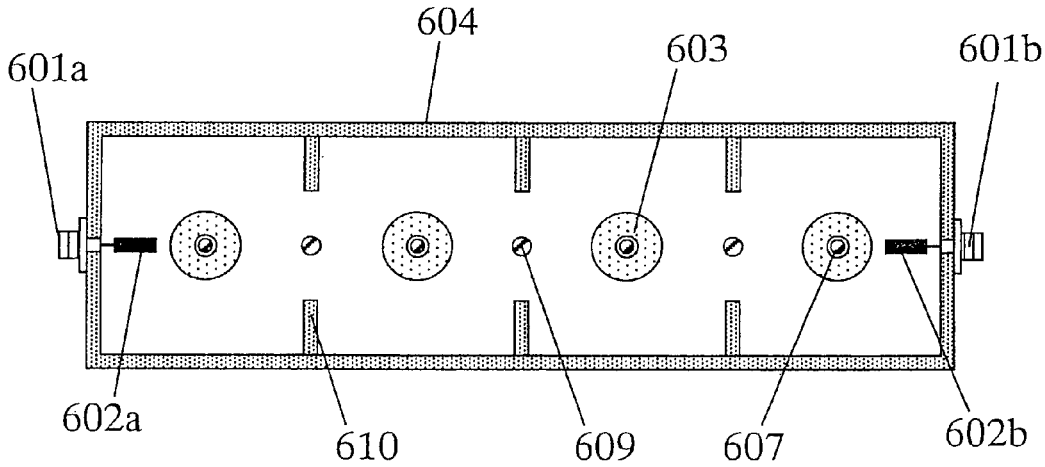

FIG. 8(*a*) is a vertical cross-sectional view of a dielectric filter in Embodiment 4 of the present invention. FIG. 8(*b*) is a horizontal cross-sectional view of the dielectric filter in Embodiment 4 of the present invention.

FIG. 9(*a*) is a vertical cross-sectional view of a conventional dielectric filter. FIG. 9(*b*) is a horizontal cross-sectional view of the conventional dielectric filter.

Figure 10:
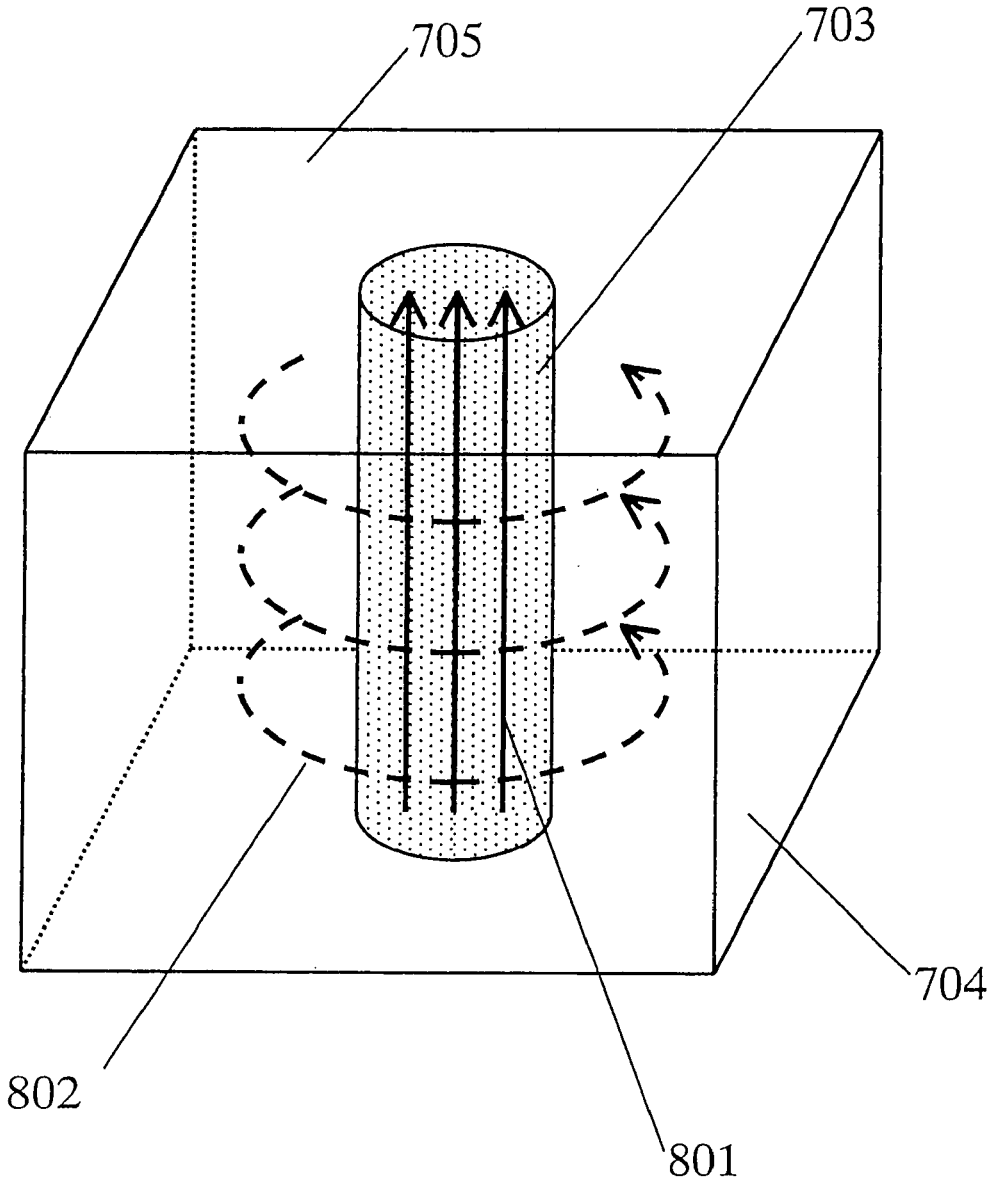
Fig. 10 PRIOR ART

FIG. 10 is a diagram showing an electromagnetic field distribution in the conventional dielectric resonator.

DESCRIPTION OF SYMBOLS

101 Input/output terminal
102 Input/output probe
103 Dielectric resonance element
104 Metallic casing
105 Metallic cover
106 Connecting screws
107 Frequency adjusting screw
108 Metalized surface
201 Thick portion
202 Thin portion
301 Cover
302 Cover connecting screw
303 Rounded portion
401 Copper foil
402 Solder
403 Cover
501 Metallic cover
601 Input/output terminal
602 Input/output probe
603 Dielectric resonance element
604 Metallic casing
605 Metallic cover
606 Connecting screw
607 Frequency adjusting screw
608 Metalized surface
609 Interstage-coupling adjusting screws
610 Partition wall
701 Input/output terminal
702 Input/output probe
703 Dielectric resonance element
704 Metallic casing
705 Metallic cover
706 Connecting screw
707 Frequency adjusting screw
801 Electric line of force
802 Magnetic line of force

PREFERRED EMBODIMENTS OF THE INVENTION (Embodiment 1)

A dielectric resonator in Embodiment 1 of the present invention will be described with reference to the drawings.

Figure 1:
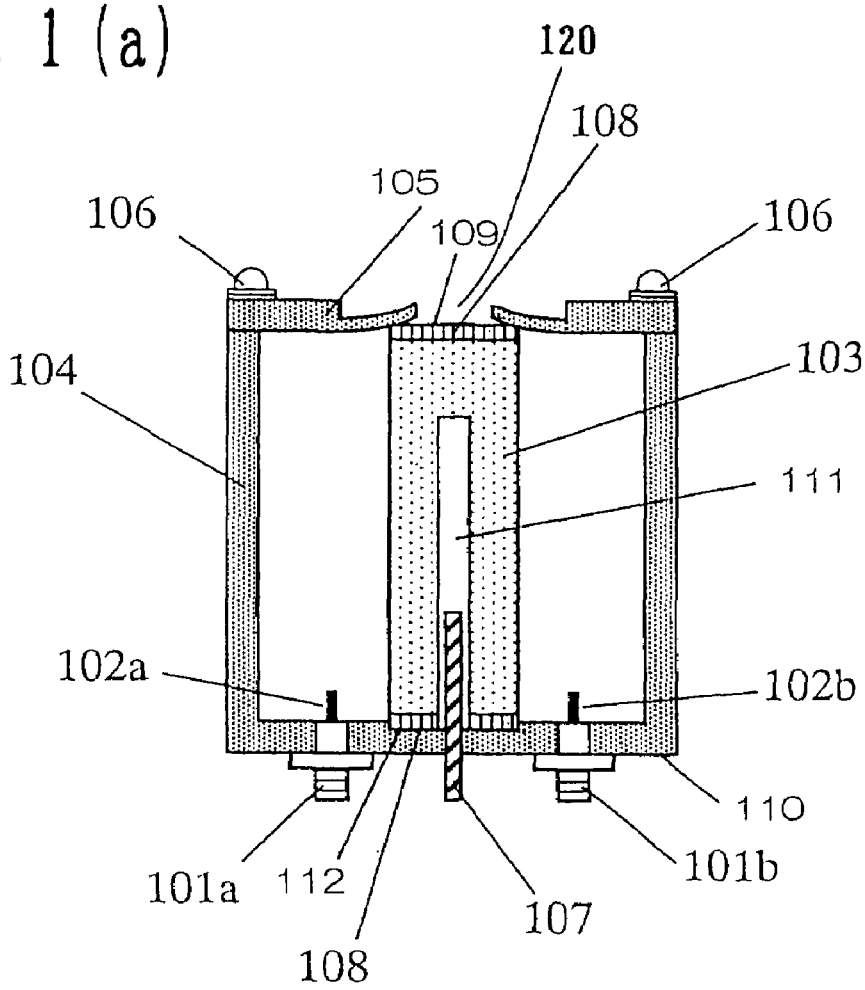
FIG. 1(*a*) is a cross-sectional view of a dielectric resonator in Embodiment 1 of the present invention.
Figure 1:
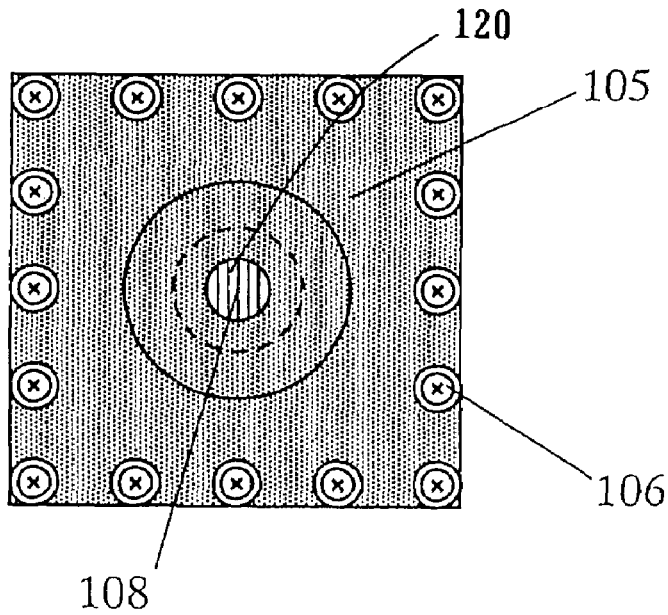
Figure 2:
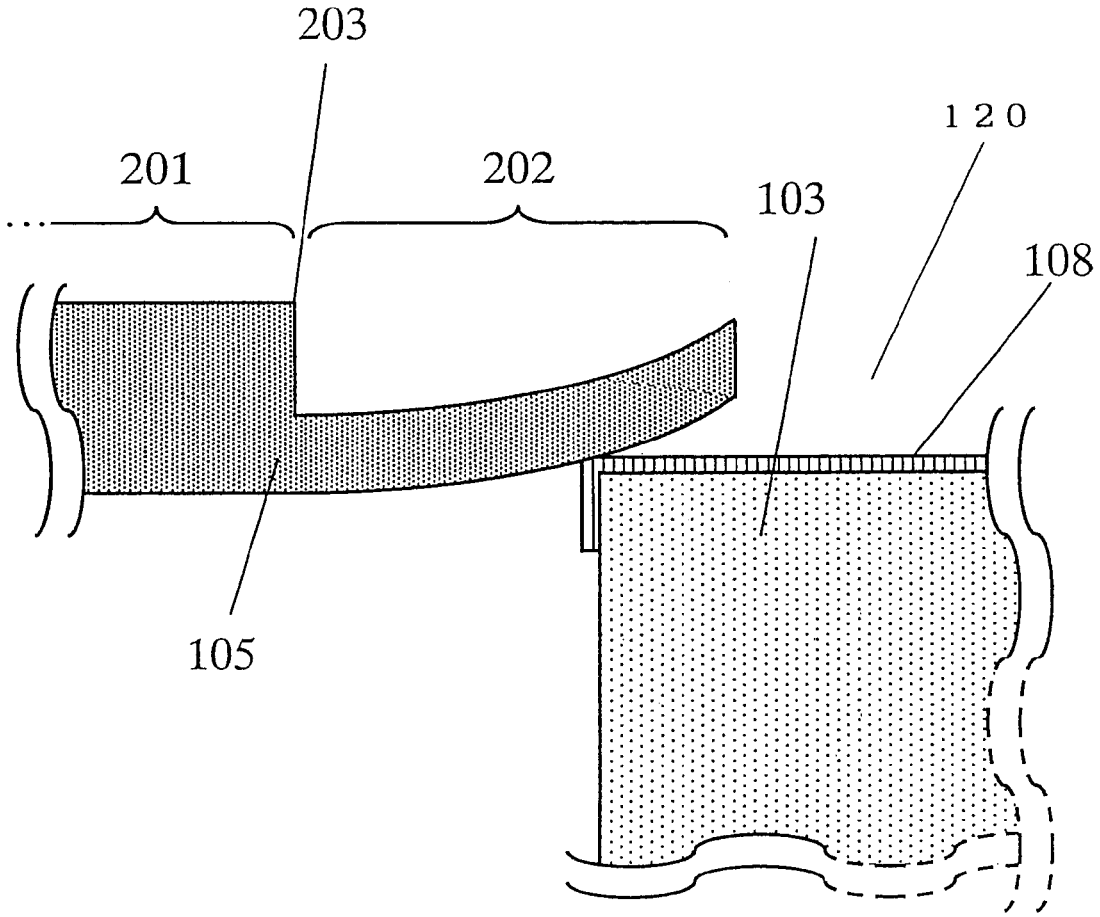
FIG. 2 is an enlarged sectional view of a metalized surface of the dielectric resonance element in the dielectric resonator in Embodiment 1 of the present invention.

FIG. 1(*a*) is a cross-sectional view of a TM mode dielectric resonator in Embodiment 1 of the present invention. FIG. 1(*b*) is a top view of the dielectric resonator. FIG. 2 is an enlarged sectional view of a metalized surface 108, which is an example of the electroconductive film in accordance with the present invention in a dielectric resonance element, and which is provided in a dielectric resonance element 103 used in the dielectric resonator in Embodiment 1 of the present invention. Referring to FIGS. 1(*a*), 1(*b*), and 2, the dielectric resonator includes input/output terminals 101*a* and 101*b*, input/output probes 102*a* and 102*b*, a dielectric resonance element 103, a metallic casing 104, a metallic cover 105, connecting screws 106, a frequency adjusting screw 107, and the metalized surface 108, and the metallic cover 105 has a thick portion 201 and a thin portion 202. The dielectric resonance element 103 has an upper flat surface 109 in its upper portion, which is an example of one of the flat surfaces in accordance with the present invention, and a lower flat surface 112 in its lower portion, which is placed opposite from the upper flat surface 109, and which is an example of the other of the flat surfaces in accordance with the present invention. To form the thin portion 202 in the metallic cover 105, countersinking is performed on an upper portion of on a plate having a thickness equal to that of the thick portion 201 to a depth corresponding to the difference between the thick portion 201 and the thin portion 202.

As a material of the metallic casing 104, such as copper (its linear expansion coefficient: 16.5 ppm/° C.), aluminum (23.1 ppm/° C.), silver (18.9 ppm/° C.), brass (17.5 ppm/° C.), iron (11.8 ppm/° C.), phosphor bronze (ppm/° C.) might be used. As a material of a dielectric resonance element 103, one with its linear expansion coefficient is, for example, between 3 and 15 might be used.

The input/output probes 102*a* and 102*b* are connected to center conductors of the input/output terminals 101*a* and 101*b* by soldering or the like. The dielectric resonance element 103 is, for example, cylindrical, and the upper flat surface 109 and the lower flat surface 112 are metalized with a metal having high conductivity such as gold, silver or copper, as shown in FIG. 2. Also in the side surface of the dielectric resonance element 103, partial side surface regions respectively connected to the upper flat surface 109 and the lower flat surface 112 are metalized with the same metal.

In the TM mode resonator, the current flowing through the inner wall of the metallic casing 104 largely influences the Q-value representing the performance of the resonator because of a characteristic of the TM mode. For this reason, a casing made of copper or aluminum and plated with silver is used as the metallic casing 104 and a countersunk slightly larger than the flat surface of the dielectric resonance element 103 is provided in a central portion of a bottom surface 110 of the metallic casing 104. The dielectric resonance element 103 is placed at a center of the metallic casing 104 by being fitted in the countersunk. The dielectric resonance element 103 is placed in the metallic casing 104 in this manner, the metallic cover 105 is then placed on the dielectric resonance element 103 and the metallic casing 104, and the metallic casing 104 and the metallic cover 105 are connected to each other by connecting screws 106.

The height of the dielectric resonance element 103 is set to such a value that the dielectric resonance element 103 protrudes slightly beyond the frame upper end of the metallic casing 104, and that the protrusion is maintained in a temperature range in which the dielectric resonator is supposed to be used. The thin portion 202 of the metallic cover 105 is warped according to the length of the above-described protrusion when the metallic casing 104 and the metallic cover 105 are connected by screwing with the connecting screws 106. That is, the thin portion 202 is warped in the above-described manner to press the upper flat surface 109 of the dielectric resonance element 103 by a biasing force.

To adjust this biasing force by adjusting the amount of warpage of the thin portion 202 of the metallic cover 105, the thick portion 201 is provided adjacent to the thin portion 202 in the metallic cover 105. To release stress in the metal when the above-described warp is caused in the thin portion 202, a hole 120 having a diameter smaller than the outside diameter of the dielectric resonance element 103 is formed in the metallic cover 105 at a center of the same. Thus, the thin portion 202 (the portion around the hole 120 that the dielectric resonance element 103 contacts) forms the resilient portion in accordance with the present invention or the thin portion 202 and the thick portion 201 (the portion other than the portion around the hole 120) form the resilient portion in cooperation with each other to press the upper flat surface 109 by the biasing force so as to follow the expansion/contraction of the dielectric resonance element 103. Typically, the expansion coefficient of the metallic casing 104 is larger than that of the dielectric resonance element 103. When the ambient temperature decreases, therefore, a larger biasing force is applied from the resilient portion to the dielectric resonance element 103 because of the relative expansion of the dielectric resonance element 103 in the axial direction. On the other hand, in a case where the expansion coefficient of the metallic casing 104 is smaller than that of the dielectric resonance element 103, a larger force based on the resilience is applied to the dielectric resonance element 103 when the ambient temperature rises.

Figure 4:
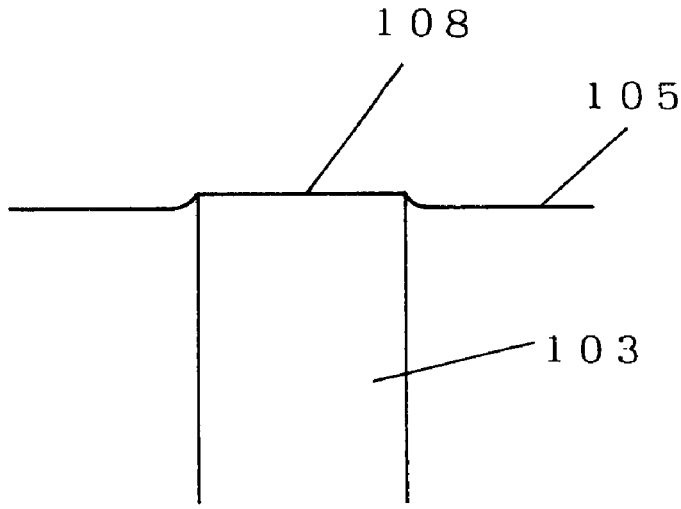
FIG. 4(*a*) is a diagram schematically showing a dielectric resonator in Embodiment 1 of the present invention. FIG.
Figure 4:
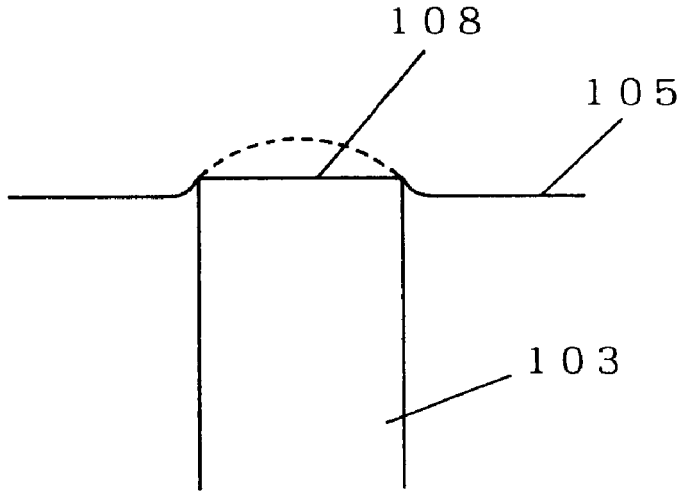

The current path connecting the metallic cover 105 and the metalized surface 108 is formed only at an outer circumferential portion (edge) of the metalized surface 108. That is, the metallic cover 105 and the metalized surface 108 contact in a line contact manner. Even when the ambient temperature changes, this line contact is maintained and there is no electrical characteristic problem. Therefore, this line contact is preferable. If the metallic cover 105 and the metalized surface 108 contact in a surface contact manner, the metalized surface 108 is separated to cause a change in electrical characteristic when the ambient temperature changes. FIG. 4(*a*) schematically shows a state where the metallic cover 105 and the metalized surface 108 contact in a surface contact manner, and FIG. 4(*b*) schematically shows the condition of the surface contact when the ambient temperature changes in the state shown in FIG. 4(*a*). When the ambient temperature changes, the dielectric resonance element 103 expands for example. A force is thereby applied to the metallic cover 105 to deform the same above the metalized surface 108, as indicated by the broken line in FIG. 4(*b*). When this force is applied, the metalized surface 108 can be easily separated from the dielectric resonance element 103.

An inner hole 111, which is formed so as not to extend through the entire length of the dielectric resonance element 103, is provided in the dielectric resonance element 103. In the inner hole 111 in which an electric field is concentrated, the frequency adjusting screw 107 connected to the metallic casing 104 is inserted to enable the resonance frequency of the dielectric resonator to be changed. A signal input to the input/output terminal 101*a* is transferred by electromagnetic coupling between the input/output probe 102*a* and the dielectric resonance element 103 and electromagnetic coupling between the dielectric resonance element 103 and the input/output probe 102*b* to be output through the input/output terminal 101*b*. Thus, this dielectric resonator according to this embodiment operates as a TM010 mode dielectric resonator.

Temperature stability is ordinarily required of high-frequency devices and dielectric resonators. In the dielectric resonator of the present invention, each of the upper flat surface 109 and the lower flat surface 112 of the dielectric resonance element 103 is metalized. Therefore, even when the ambient temperature changes, no gap occurs between the metalized surface 108 functioning as a ground electrode and the upper flat surface 109 of the dielectric resonance element 103 and between the metalized surface 108 and the lower flat surface 112. Since there is a difference between the linear expansion coefficients of the dielectric resonance element 103 and the metallic casing 104, the dielectric resonance element 103, for example, expands in the axial direction relative to the metallic casing 104 when the ambient temperature changes. However, the amount of expansion is absorbed by a warp of the thin portion 202 of the metallic cover 105. Therefore, dielectric resonator can be made always stable in characteristics even when the temperature of the dielectric resonator is changed.

In the TM mode dielectric resonator, the contact between the upper flat surface 109 of the dielectric resonance element 103 and the ground electrode and the contact between the lower flat surface 112 and the ground electrode are very important. If a gap occurs therebetween, the resonance frequency and the Q-value are largely changed. Wave vectors in the TM010 mode have only components in the radial direction and the resonance frequency of the dielectric resonator is independent of the height of the dielectric resonance element 103. In the dielectric resonator in Embodiment 1 of the present invention, therefore, a method of producing a characteristic effect not in the radial direction but in the height direction of the dielectric resonance element 103 is used as a method for ensuring contact between the upper flat surface 109 of the dielectric resonance element 103 and the ground electrode and contact between the lower flat surface 112 and the ground electrode at all times with stability, thereby enabling stabilization of the resonance frequency of the dielectric resonator.

As described above, in the dielectric resonator of this embodiment, the outer circumferential portion of the metalized surface 108 of the dielectric resonance element 103 and the metallic cover 105 can be maintained in contact with each other at all times under any temperature condition by the biasing force of the resilient portion formed in the metallic cover 105. Therefore, a dielectric resonator and a dielectric filter can be provided which are free from discontinuity of the current path, and which have improved temperature characteristics and high reliability.

In this embodiment, the structure for absorbing the difference between the linear expansion coefficients of the dielectric resonance element 103 and the metallic casing 104 is provided above the dielectric resonance element 103, because the frequency adjusting screw 107 is provided in and below a lower portion of the dielectric resonance element 103. Needless to say, the same effects can also be obtained in a case where the structure for absorbing the difference between the linear expansion coefficients of the dielectric resonance element 103 and the metallic casing 104 is placed below the dielectric resonance element 103, and the frequency adjusting screw 107 is placed above the dielectric resonance element 103. In such a case, the arrangement may be such that not a portion of the metallic cover 105 but a portion of the bottom surface 110 (bottom portion) is warped to apply a biasing force to the lower flat surface 112 of the dielectric resonance element 103.

While the description has been made by assuming that a hole is formed in the metallic cover 105, the same effects as those described above can also be obtained without forming such a hole, if the arrangement is such that the thin portion 202 forms the resilient portion in accordance with the present invention or the thin portion 202 and the thick portion 201 form the resilient portion in accordance with the invention in cooperation with each other to press the upper flat surface 109 or the lower flat surface 112 by a biasing force so as to follow the expansion/contraction of the dielectric resonance element 103.

While preference of line contact between the metallic cover 105 and the metalized surface 108 has been mentioned, the same effects can also be obtained by using surface contact except for the problem that the metalized surface 108 can separate easily. In the case of use of surface contact, there is a possibility of the area of contact between the metallic cover 105 and the metalized surface 108 being changed. For example, the area of contact between the metallic cover 105 and the metalized surface 108 is small as shown in FIG. 5(*a*) when the ambient temperature is high, but the metallic cover 105 and the metalized surface 108 contact by a larger contact area as shown in FIG. 5(*b*) when the ambient temperature is low. It can be said that the same effects as those described above can also be obtained in such a case if at least a portion of the metallic cover 105 is warped to bias the flat surface of the dielectric resonance element 103 when the ambient temperature changes.

While the description has been made with respect to a case where the thin portion 202 is provided in the metallic cover 105, the same effects can also be obtained in a case where such a portion is provided in the metallic casing 104.

Figure 3:
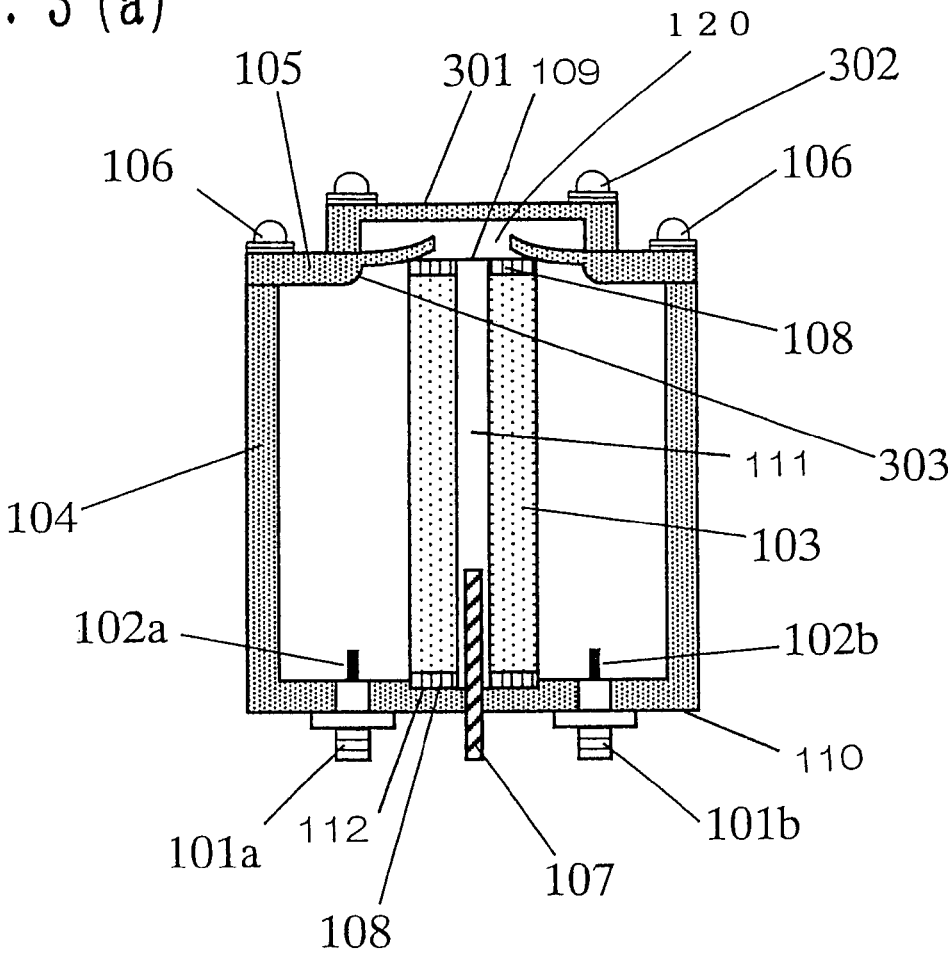
FIG. 3(*a*) is a cross-sectional view of a dielectric resonator in Embodiment 1 of the present invention.
Figure 3:
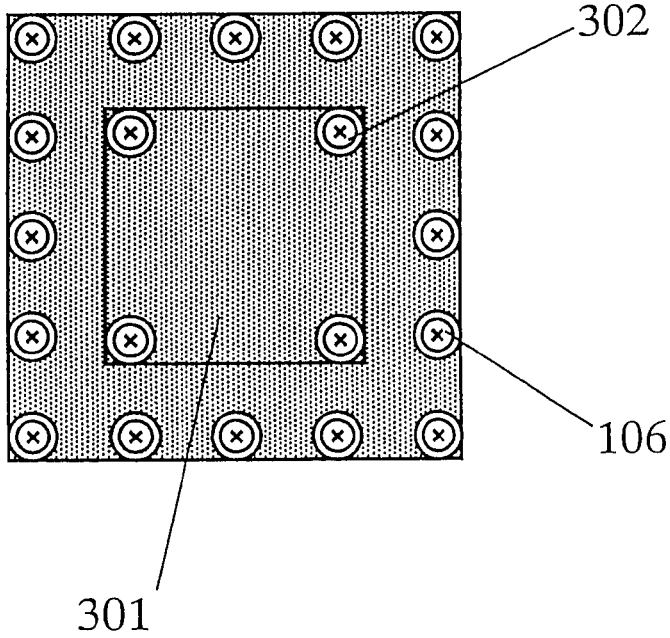

While the description has been made with respect to a case where countersinking is performed on an upper portion of a plate having a thickness equal to that of the thick portion 201 to a depth corresponding to the difference between the thick portion 201 and the thin portion 202 to provide the thin portion 202 in the metallic cover 105, an arrangement may alternatively be adopted in which, as shown in FIGS. 3(*a*) and 3(*b*), the metallic cover 105 shown in FIGS. 1(*a*) and 1(*b*) is turned upside down so that the above-described countersunk faces the interior of the metallic casing 104. The height of the metallic casing 104 is thereby reduced by an amount corresponding to the difference between the thicknesses of the thick portion 201 and the thin portion 202. The overall height of the dielectric resonator can be reduced in this manner. In such a case, if a projection 203 shown in FIG. 2, at which the thick portion 201 and the thin portion 202 connect to each other, exists inside the casing, current concentration occurs thereon to cause a reduction in the Q-value of the dielectric resonator. Therefore, the projection 203 is rounded to form a rounded portion 303, as shown in FIGS. 3(*a*) and 3(*b*), thereby enabling the dielectric resonator to be reduced in height without reducing the Q-value.

In a case where the metallic cover 105 is formed only of the thin portion 202 without providing the thick portion 201, the metallic cover 105 can be also warped, although the resiliency in this arrangement differs from that in the above-described arrangement. In this manner, a dielectric resonator in which a biasing force is applied to the dielectric resonance element 103 at any temperature to ensure stabilized characteristics can be provided, as is that described above.

While the metalized surface 108 is exposed through the hole 120 of the metallic cover 105 in the arrangement described with reference to FIGS. 1(*a*), 1(*b*), and 2, it is possible to further attach a metallic or nonmetallic cover 301 above the metallic cover 105 with cover connecting screws 302, as shown in FIGS. 3(*a*) and 3(*b*). In such a case, an improvement in the effect of preventing separation of the metalized surface 108 of the dielectric resonance element 103 can be expected as well as an improvement in the mechanical strength of the dielectric resonator, without variation in the electrical characteristics.

While description has been made of the provision of the non-through inner hole 111 in the dielectric resonance element 103, it is also possible to change the resonance frequency of the dielectric resonator with the frequency adjusting screw 107 in the same manner even if the inner hole 111 is formed as a through hole. In such a case, the manufacturing cost of the dielectric resonance element 103 can be reduced. The above-described cover 301 may be attached to the dielectric resonator formed in this manner to improve the stability of the electrical characteristics.

Even in the case of an arrangement in which the metalized surface 108 on the lower flat surface 112 is removed, no gap occurs between the lower flat surface 112 and the metallic casing 104 when the dielectric resonance element 103 and the metallic casing 104 expand or contract in the height direction due to a change in temperature. Therefore, stabilized temperature characteristics are also ensured in this case. Further, the Q-value of the dielectric resonator can be improved since a current cannot flow easily through the metalized surface 108 having a conductance lower than that of the metallic casing 104.

While the dielectric resonance element 103 is cylindrical in the above-described arrangement, a dielectric resonator having a dielectric resonance element 103 in the form of a rectangular block can also operate as a TM mode dielectric resonator.

While the description has been made with respect to a case where the dielectric resonance element 103 is placed in the height direction, the dielectric resonance element 103 may be placed in any direction if a structure capable of absorbing expansion/contraction of the dielectric resonance element 103 due to a change in ambient temperature is provided.

(Embodiment 2)

A dielectric resonator in Embodiment 2 of the present invention will be described with reference to the drawing.

FIG. 6 is a cross-sectional view of a TM mode dielectric resonator in Embodiment 2 of the present invention. Description of the same portions as those in Embodiment 1 will not be repeated. Referring to FIG. 6, the dielectric resonator includes copper foil 401, which is an example of the thin film in accordance with the present invention, solder 402, and a cover 403.

As shown in FIG. 6, a metalized surface 108 at the lower end of a dielectric resonance element 103 and a bottom surface 110 of a metallic casing 104 are electrically connected to each other by solder 402. Copper foil 401 is provided at the upper end of the dielectric resonance element 103, and the copper foil 401 and the metalized surface 108 at the upper end of the dielectric resonance element 103 are electrically connected to each other by solder 402. The copper foil 401 and the metallic casing 104 are connected with reliability by screwing connecting screws 106 from above the cover 403. In this arrangement, the difference between the linear expansion coefficients of the dielectric resonance element 103 and the metallic casing 104 in the height direction can be absorbed by warpage (i.e., ductility) of the copper foil 401. That is, even when the ambient temperature changes to cause expansion/contraction of the dielectric resonance element 103, the copper foil 401 is warped upwardly or downwardly to maintain connection between the upper flat surface 109 of the dielectric resonance element 103 and the copper foil 401. Therefore, no gap occurs between the dielectric resonance element 103 and the upper metalized surface 108 and there is no considerable influence on the resonance frequency and the Q-value. Also, the dielectric resonator can stand a heat cycle test and has improved reliability.

Since the current path in the ground electrode is formed on the inner surfaces of the metallic casing 104 and the copper foil 401, no grounding current flows through the cover 403. Therefore, the cover 403 may be made of any material selected from metals and nonmetallic materials. However, the cover 403 needs to have solidity such as not to be deformed due to a change in temperature, an impact, or any other action.

Needless to say, the same effects can also be obtained in a case where an electroconductive adhesive, silver paste or the like is used instead of solder 402.

By considering the facility with which the copper foil 401 and the metalized surface 108 are connected, an arrangement may be adopted in which a hole having a diameter smaller than the outside diameter of the dielectric resonance element 103 is provided in the copper foil 401 at a center of the same and the copper foil 401 and the metalized surface 108 are connected by solder 402. The same current path is also formed in this case. Therefore, the same effects as those described above can also be obtained. Also, a reduction in difficulty of soldering can be expected in this case.

The cover 403 is provided to improve the reliability of connection between the metallic casing 104 and the copper foil 401. Even if a hole is formed in the cover 403 at a center of the same, stabilized characteristics can also be obtained. The frequency adjusting screw 107 maybe inserted in this hole.

Also, the same effects can be obtained irrespective of the diameter of a countersunk 404 provided in the cover 403 if the diameter of the countersunk 404 is smaller than the size of the cavity of the metallic casing 104 and is larger than the outside diameter of the dielectric resonance element 103.

The same effects can also be obtained in a case where a thin iron plate with silver plating having high conductivity is used in place of copper foil 401 in this embodiment.

(Embodiment 3)

A dielectric resonator in Embodiment 3 of the present invention will be described with reference to the drawing.

FIG. 7 is a cross-sectional view of a TM mode dielectric resonator in Embodiment 3 of the present invention. Description of the same portions as those in Embodiments 1 and 2 will not be repeated.

As shown in FIG. 7, a thin portion 522 is provided in a metallic cover 501, a metalized surface 108 at the lower end of a dielectric resonance element 103 and a bottom surface 110 of a metallic casing 104 are electrically connected to each other by solder 402, and the metalized surface 108 at the upper end of the dielectric resonance element 103 and the thin portion 522 of the metallic cover 501 are electrically connected to each other by using solder 402.

Also in the thus-arranged dielectric resonator, the difference between the vertical lengths of the metallic casing 104 and the dielectric resonance element 103 at the time of expansion/contraction can be absorbed, as is that in the dielectric resonator in Embodiment 2.

Either of the metalized surface 108 provided on the upper flat surface 109 of the dielectric resonance element 103 and the metalized surface 108 extending on the side surface of the dielectric resonance element 103 may be soldered to the thin portion 522 of the metallic cover 501.

(Embodiment 4)

A dielectric filter using the dielectric resonator in Embodiment 1 of the present invention will be described with reference to the drawings.

FIG. 8(*a*) is a cross-sectional view of the dielectric filter of the present invention, and FIG. 8(*b*) is a top cross-sectional view taken along the line A–A' in FIG. 8(*a*). Description of the same portions as those in Embodiment 1 will not be repeated. Referring to FIGS. 8(*a*) and 8(*b*), the dielectric filter has input/output terminals 601*a* and 601*b*, input/output probes 602*a* and 602*b*, dielectric resonance elements 603, 603*a*, 603*b*, 603*c*, and 603*d*, a metallic casing 604, a metallic cover 605, connecting screws 606, frequency adjusting screws 607*a*, 607*b*, 607*c*, and 607*d*, metalized surfaces 608, interstage-coupling adjusting screws 609*a*, 609*b* and 609*c* and partition walls 610.

The input/output terminals 601*a* and 601*b* are positioned on side portions of the metallic casing 604. Each of the input/output probes 602*a* and 602*b* connected to center conductors of the input/output terminals 601*a* and 601*b* extends in the form of a plate in the same direction as the center conductor, is bent through ninety degrees at a position in the vicinity of the dielectric resonance element 603, and is electrically connected to a bottom surface 910 of the metallic casing 604 by fastening with a screw or soldering for example. Each input/output coupling is determined by the thickness and width of the plate of the input/output probe 602*a* or 602*b* and the distance between the input/output probe 602*a* or 602*b* and the dielectric resonance element 603*a* or 603*d*. Interstage couplings between the dielectric resonance elements 603*a* to 603*d* are determined by the intervals between the dielectric resonance elements and the lengths of the partition walls 610. Interstage couplings therebetween are respectively adjusted finely with the interstage-coupling adjusting screws 609*a* to 609*c*. The resonance frequencies of the dielectric resonance element 603*a* to 603*d* are respectively adjusted with the frequency adjusting screws 607*a* to 607*d*. The input/output couplings, the interstage couplings and the resonance frequencies of the dielectric resonators are suitably adjusted to realized a dielectric filter having 4-stage bandpass filter characteristics.

According to this embodiment, as described above, a reliable dielectric filter can be obtained in which stabilized characteristics can be realized even when the temperature of the filter is changed and which can stand a heat cycle test.

While an arrangement using four stages formed by the dielectric resonators in accordance with Embodiment 1 has been described as a dielectric filter in this embodiment, the same effects can also be obtained by using dielectric resonators in accordance with Embodiment 2 or 3.

The dielectric filter of the present invention can have stabilized characteristics as a filter having a plurality of stages not limited to four stages.

(Example 1)

As the dielectric resonance element 103 of the dielectric resonator in Embodiment 1, a cylindrical dielectric resonance element having a resonance frequency in the 2 GHz band, a specific dielectric constant of about 40, an outside diameter of 9 mm and a height of 32.00 mm was used. The upper flat surface 109 and the lower flat surface 112 of the dielectric resonance element 103 were metalized with gold to a thickness of about 10 to 40 μm. Side surface regions having a width of about 0.3 to 1 mm from the upper flat surface 109 and the lower flat surface 112 were also metalized in the same manner.

A member made of copper and plated with silver was used as the metallic casing 104, and a countersunk having a diameter of 9.2 mm and a depth of 0.3 mm was provided in the bottom surface 110 of the metallic casing 104 at the center of the same. The dielectric resonance element 103 was placed at the center of the metallic casing 104 by being fitted in this countersunk. The distance between the upper end surface of the metallic casing 104 and the bottom surface of the countersunk bottom having a depth of 0.3 mm was set to 31.7 mm. In this arrangement, since the height of the dielectric resonance element 103 is 32.00 mm, the dielectric resonance element 103 protrudes beyond the frame upper end of the metallic casing 104 by 0.3 mm, and the thin portion 202 of the metallic cover 105 is warped by an amount corresponding to the 0.3 mm protrusion when the metallic casing 104 and the metallic cover 105 are fastened to each other with connecting screws 106. This dielectric resonator was subjected to a heat cycle test in which a temperature change from −40 to 80° C. was caused many times. The results of this test show that the dielectric resonator in accordance with Embodiment 1 has high reliability such as to stand this temperature change.

(Example 2)

As the dielectric resonance element 103 of the dielectric resonator in Embodiment 2, the same dielectric resonance element as that in Example 1 was used and copper foil 401 having a thickness of 0.05 mm was used. It was found that even when the dielectric resonance element 103 expanded or contracted due to a change in ambient temperature, no gap occurred between the dielectric resonance element 103 and the upper metalized surface 108 and there was no considerable influence on the resonance frequency and the Q-value. It was also found that the dielectric resonator in accordance with Embodiment 2 had high reliability such as to stand the heat cycle test.

The dielectric resonator in the above-described examples has a size and uses materials such as to have a resonance frequency in the 2 GHz band. Needless to say, this is only an example of the present invention and the same effects can also be obtained when the size and the materials are changed with a different resonance frequency.

In the above description, the expansion/contraction of each dielectric resonance element with respect to temperature means expansion/contraction relative to the metallic casing. Therefore, each dielectric resonance element may expand relative to the metallic casing when it contracts due to a change in temperature. Conversely, each dielectric resonance element may contract relative to the metallic casing when it expands due to a change in temperature. Even in such cases, the same effects can be obtained as long as the same operation as that described above is performed.

The dielectric resonator in accordance with the present invention or a device using a dielectric resonance element supported by the dielectric resonance element supporting method in accordance with the present invention is capable of operating with stability even when the temperature thereof is changed and is advantageously used as a dielectric resonator, dielectric filter or the like in a base station for mobile communication such as portable telephone, a transmitting station for broadcasting, and the like.

What is claimed is:

1. A dielectric resonator comprising:

a metallic casing having an opening;

a metallic cover which covers said opening; and a dielectric resonance element having a pair of flat surfaces formed opposite from each other, one of the pair of flat surfaces contacting a bottom portion of said casing, wherein at least one of said cover and said bottom portion has a resilient portion which supports said dielectric resonance element and presses said one of the pair of flat surfaces by a biasing force so as to follow expansion or contraction of said dielectric resonance element due to a change in temperature, and wherein the biasing force applied from said resilient portion is obtained by bent portion of said cover or a bent portion of said bottom portion contacting one of said pair of flat surfaces or an edge portion thereof, said bent portion in contact being bent in a direction away from the one of said pair of flat surfaces or an edge portion thereof.

2. The dielectric resonator according to claim 1, wherein the other of said pair of flat surfaces or an edge portion thereof is covered with an electroconductive film.

3. The dielectric resonator according to claim 2, wherein said electroconductive film is formed by metalization.

4. The dielectric resonator according to claim 2, wherein said resilient portion and the edge portion of the other of said flat surfaces contact in a line contact manner.

5. The dielectric resonator according to claim 1, wherein a hole having a size not exceeding the size of the other of said pair of flat surfaces is formed in said cover, wherein the other of said pair of flat surfaces or the edge portion thereof contacts a portion on the periphery of said hole so as to close said hole, and wherein the portion on the periphery of the hole in said cover is warped according to relative expansion of the dielectric resonance element in the axial direction due to a change in temperature to increase the biasing force.

6. The dielectric resonator according to claim 5, wherein the thickness of the portion on the periphery of said hole is smaller than the other portion of said cover.

7. The dielectric resonator according to claim 6, wherein the portion on the periphery of said hole is formed by countersinking said cover on the side where the other of said pair of flat surfaces contacts said cover.

8. The dielectric resonator according to claim 5, wherein another cover is provided over said cover so as to cover said hole.

9. The dielectric resonator according to claim 6, wherein the portion on the periphery of said hole and the other portion of said cover connected to each other with being rounded at the connection so as not to form an edge in said casing.

10. A dielectric filter comprises dielectric resonators according to claim 1, the dielectric resonators being connected one after another to form a plurality of stages.

11. A method of supporting a dielectric resonance element comprising:

a step of bringing one of a pair of flat surfaces of a dielectric resonance element having flat surfaces opposed to each other into contact with a bottom portion of a metallic casing having an opening; and a step of causing at least one of a metallic cover covering the opening and the bottom portion to press one of the pair of flat surfaces or an edge portion thereof by a biasing force so as to follow expansion or contraction of the dielectric resonance element due to a change in temperature, wherein the biasing force is obtained by a bent portion of the cover or a bent portion of said bottom portion contacting one of the pair of flat surfaces or an edge portion thereof, said bent portion in contact being bent in a direction away from the one of said pair of flat surfaces or an edge portion thereof.

* * * * *